US006971854B2

(12) United States Patent
Krakowski

(10) Patent No.: US 6,971,854 B2
(45) Date of Patent: Dec. 6, 2005

(54) MOBILE KIT FOR CEILING FAN

(76) Inventor: Kimberly Ellis Krakowski, 506 Ivy Cir., Alexandria County of Alexandria City, VA (US) 22302

( * ) Notice: Subject to any disclaimer, the term of this patent is extended or adjusted under 35 U.S.C. 154(b) by 78 days.

(21) Appl. No.: 10/786,826

(22) Filed: Feb. 25, 2004

(65) Prior Publication Data

US 2005/0186073 A1 Aug. 25, 2005

(51) Int. Cl.[7] ..... F04D 29/38
(52) U.S. Cl. ..... 416/146 R
(58) Field of Search ..... 416/146 R

(56) References Cited

U.S. PATENT DOCUMENTS

| | | | | |
|---|---|---|---|---|
| 5,097,398 | A * | 3/1992 | Dye | 362/147 |
| D364,223 | S | 11/1995 | DiPasquale | |
| 5,658,129 | A | 8/1997 | Pearce | |
| 5,685,426 | A | 11/1997 | Marshall | |
| 5,722,814 | A | 3/1998 | Yu | |
| 5,947,283 | A | 9/1999 | Marshall | |
| 6,082,868 | A | 7/2000 | Carpenter | |
| 6,199,813 | B1 | 3/2001 | Oliva | |
| 6,290,778 | B1 | 9/2001 | Zugibe | |
| 6,302,556 | B1 | 10/2001 | Filip | |
| 6,357,714 | B1 | 3/2002 | Johnson | |
| 6,464,524 | B1 | 10/2002 | Kerr, Jr. et al. | |
| 6,494,589 | B1 | 12/2002 | Shyu | |
| 6,502,337 | B1 | 1/2003 | Ochi | |
| 6,585,487 | B2 | 7/2003 | Nodd et al. | |
| D482,112 | S | 11/2003 | Miller | |
| 6,644,927 | B2 | 11/2003 | Bucher et al. | |

* cited by examiner

*Primary Examiner*—Ninh H. Nguyen
(74) *Attorney, Agent, or Firm*—Hunton & Williams LLP

(57) ABSTRACT

The invention generally relates to a mobile kit for use with a ceiling fan, the kit comprising a plurality of fan ornament assemblies, each fan ornament assembly including a collar device adapted for attaching to a fan blade, a support cord having a first end and a second end, the first end attached to the collar device, an ornamental object attached to the second end of the support cord. The support cord is adapted to suspend the ornamental object when the collar device is attached to the fan blade.

24 Claims, 2 Drawing Sheets

MOBILE KIT FOR CEILING FAN

BACKGROUND OF THE INVENTION

Electric ceiling fans are commonly utilized to assist heating and air conditioning systems by providing an additional degree of air circulation within the confines of a room. Since many ceiling fans are so visible when installed, they become part of the interior decoration of a room. For the interior decoration of many rooms, most notably a child's room, such interior decoration normally encompasses a theme reflecting a particular interest. These interests may include novelty or cartoon characters which are familiar to the child, which may change over time to accommodate the child's changing interests.

Accordingly, the invention provides a mobile kit for use with a ceiling fan, that meets these needs.

SUMMARY OF THE INVENTION

The invention, according to one embodiment, relates to a mobile kit for use with a ceiling fan, the kit comprising a plurality of fan ornament assemblies, each fan ornament assembly including a collar device adapted for attaching to a fan blade, a support cord having a first end and a second end, the first end attached to the collar device, an ornamental object attached to the second end of the support cord. The support cord is adapted to suspend the ornamental object when the collar device is attached to the fan blade.

The invention, according to another embodiment, relates to a mobile comprising a ceiling fan including a plurality of fan blades, each fan blade rotatably attached to a fan motor, a plurality of decorative assemblies, each decorative assembly attached to a fan blade, each decorative assembly including a collar device adapted for attaching to a fan blade, a first support cord having a first end and a second end, the first end attached to the collar device, a first ornamental object attached to the second end of the support cord, wherein the support cord is adapted to suspend the ornamental object when the collar device is attached to the fan blade.

The invention, according to another embodiment, relates to a mobile comprising a ceiling fan including a first fan blade and a second fan blade, each fan blade rotatably attached to a fan motor, a first fan ornament assembly including a first collar device attached to the first fan blade, a first support cord having an upper end and a lower end, the upper end of the first support cord attached to the first collar device, a first ornamental object attached to the second end of the first support cord, and a second fan ornament assembly including a second collar device attached to the second fan blade, a second support cord having an upper end and a lower end, the upper end of the second support cord attached to the first collar device, a second ornamental object attached to the second end of the second support cord.

BRIEF DESCRIPTION OF THE DRAWINGS

The present invention can be more fully understood by reading the following detailed description of the presently preferred embodiments together with the accompanying drawings, in which like reference indicators are used to designate like elements, and in which.

DETAILED DESCRIPTION OF PREFERRED EMBODIMENTS

Figure 1:
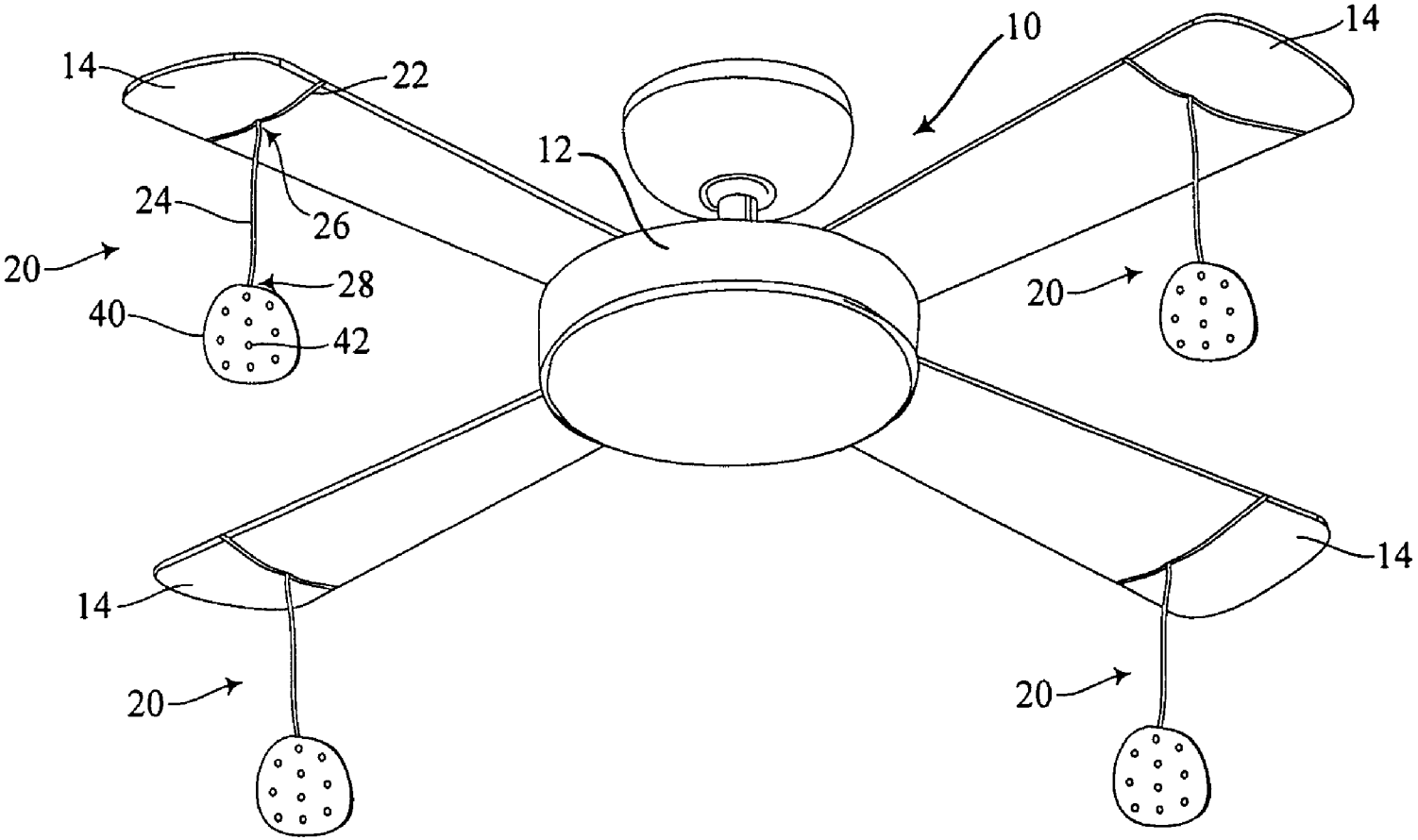
FIG. 1 is a perspective view of an illustrative fan with mobile parts attached in accordance with one embodiment of the invention.

FIG. 1 is a perspective view of an illustrative ceiling fan decorated with fan ornament assemblies in accordance with one embodiment of the invention. As shown in FIG. 1, ceiling fan 10 includes a plurality of fan blades 14 rotatably attached to a fan motor 12. In this embodiment, ceiling fan 10 is a convention electric ceiling fan that may be turned on and off as desired by the user, with fan blades 14 that are substantially planar sections of wood or other suitable material. To allow for selective operation, ceiling fan 10 further includes a switch means (not shown) that controls fan motor 12 to rotate fan blades 14. In accordance with the invention, the known use for ceiling fan 10 allows it to be adapted to operate as a rotating mobile.

To convert ceiling fan 10 into a mobile, as shown in FIG. 1, a plurality of fan ornament assemblies 20 are suspended from the fan blades 14. Each fan ornament assembly 20 includes a collar device 22, a support cord 24, and an ornamental object 40. Collar device 22 is adapted to attach to an individual fan blade 14, or fit around the body of fan blade 14, so that support cord 24 and ornamental object 40 hang from fan blade 14, suspended in air. Thus, the arrangement of collar device 22 around fan blade 14 provides support from above for fan ornament assembly 20. With a plurality of fan ornament assemblies 20 attached to fan blades 14, the user can turn on ceiling fan 10 and control its rotational speed such that ceiling fan 10 then functions as a mobile. Thus, the plurality of fan ornament assemblies 20 comprise a kit for converting a ceiling fan 10 into a mobile.

To facilitate the operation as a mobile, the fan ornament assemblies 20 must remain attached or affixed to the fan blades 14 once the ceiling fan 10 begins moving in a controlled manner. Thus, the means for attaching the fan ornament assembly to the fan blade is an important aspect of the invention. As shown in FIG. 1, collar device 22 is constructed of a flexible or elastic material that can be stretched or adjusted to fit around fan blade 14. For example, in one embodiment, collar device 22 may be comprised of a fashion garter belt. However, collar device 22 may be of any construction that allows it to be adapted to fit around fan blades of varying shapes and sizes. In this respect, collar device 22 may comprise a mechanical-like collar that can be fitted to a fan blade, such as a Velcro strap or band (hook and loop fasteners), belt-like or plastic or metal collar that can be tightened by bolts, screws, for example. Importantly, with some collar arrangements, it is not necessary that the collar fit entirely around the fan blade, or contact its entire circumference, as long as it can have enough support for the fan ornament assembly 20.

In alternate embodiments, other attachment means may be used to suspend fan ornament assemblies 20 from fan blades 14. For example, such attachment means may include clips, eye-hooks, mirror hooks, bayonet connectors, snaps, screws, Velcro attachments, for example. The respective attachment means can be attached to the fan blades, and further attach to the support cord.

Referring again to FIG. 1, support cord 24 is attached to collar device at its first end 26. Ornamental object 40 hangs from the second end 28 of support cord 24, suspended in air. A variety of materials may be used for support cord 24, including wire, cable, string, elastic, rope, twine, thread, line, chain, thread, wood dowel or other similar materials, for example. It should be appreciated that additional decorative objects may be fitted over support cord 24. For example, a decorative fabric sheath may be fitted around support cord 24, or in another embodiment, several decorative beads may be strung on support cord 24.

To allow the decorative nature of the mobile to be adjusted for varying needs and interests, ornamental object 40 may be provided in a variety of shapes and sizes and materials. For example, for use in a child's bedroom, ornamental objects 40 may be provided in the shape of cartoon characters, playtime objects such as balloons, fairytale characters, sports teams or other figures. Ornamental objects may also be constructed of a variety of materials including wood, plastic, metal, paper, cardboard, foam, cloth or similar craft materials.

Figure 2:
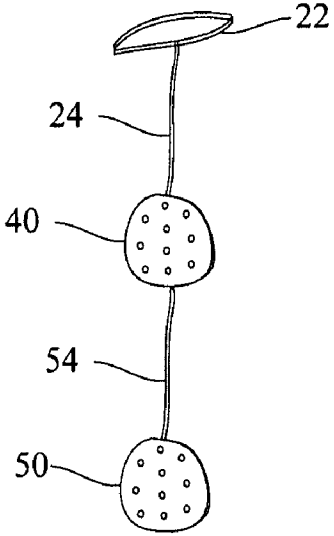
FIG. 2 is a perspective view of a fan ornament assembly in accordance with one embodiment of the invention.

Although FIG. 1 shows fan ornament assembly 20 with one ornamental object 40, it should be appreciated that each assembly may be provided with multiple ornamental objects suspended by additional support cords. FIG. 2 is a perspective view of fan ornament assembly 20 with more than one ornamental object. As shown in FIG. 2, the first support cord 24 is attached to collar device 22. The first ornamental object 40 is suspended from the first support cord 24. A second support cord 54 is attached to the bottom of the first ornamental object 40, and a second ornamental object 50 is suspended from the second support cord 54.

Figure 3:
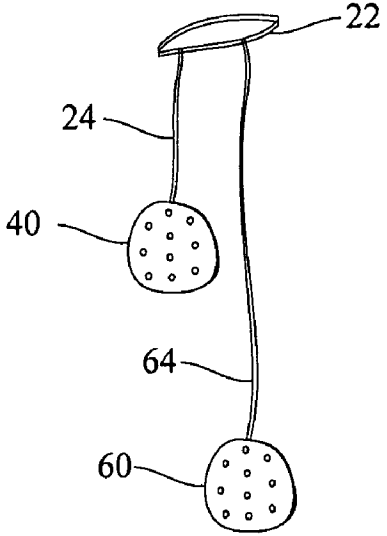
FIG. 3 is a perspective view of a fan ornament assembly in accordance with one embodiment of the invention.

In alternate embodiments, more than one support cord can be attached directly to the collar device. As shown in FIG. 3, a first support cord 24 is attached to collar device 22, and first ornamental object 40 is suspended from the first support cord 24. A second support cord 64 is attached to collar device 22, and a second ornamental object 60 is suspended from the second support cord 64.

While the foregoing description includes details and specificities, it is to be understood that these have been included for purposes of explanation only, and are not to be interpreted as limitations of the present invention. Modifications to the embodiments described above can be made without departing from the spirit and scope of the invention, which is intended to be encompassed by the following claims and their legal equivalents.

What is claimed is:

1. A mobile kit for use with a ceiling fan, the kit comprising:

a plurality of fan ornament assemblies, each fan ornament assembly including:

a collar device adapted for attaching to a fan blade;

a first support cord having a first end and a second end, the first end of the first support cord attached to the collar device;

a first ornamental object attached to the second end of the first support cord, wherein the first support cord is adapted to suspend the first ornamental object when the collar device is attached to the fan blade.

2. The mobile kit of claim 1, wherein at least one collar device is adapted to fit around the fan blade.

3. The mobile kit of claim 1, wherein at least one collar device is comprised of an elastic material.

4. The mobile kit of claim 1, wherein at least one collar device is comprised of a fashion garter belt.

5. The mobile kit of claim 1, wherein at least one collar device is comprised of a Velcro strap.

6. The mobile kit of claim 1, wherein at least one first support cord is comprised of one of wire, cable, string, elastic, rope, twine, thread, line, chain, and thread.

7. The mobile kit of claim 1, wherein at least one first support cord is covered with a decorative fabric.

8. The mobile kit of claim 1, wherein at least one first support cord is strung with a plurality of decorative beads.

9. The mobile kit of claim 1, wherein at least one first ornamental object is comprised of one of wood, plastic, metal, paper, cardboard, and foam.

10. The mobile kit of claim 1, wherein at least one fan ornament assembly further includes:

a second support cord having a first end and a second end, the first end of the second support cord attached to the first ornamental object;

a second ornamental object attached to the second end of the second support cord.

11. The mobile kit of claim 1, wherein at least one fan ornament assembly further includes:

a second support cord having a first end and a second end, the first end of the second support cord attached to the collar device;

a second ornamental object attached to the second end of the second support cord.

12. A mobile comprising:

a ceiling fan including a plurality of fan blades, each fan blade rotatably attached to a fan motor;

a plurality of decorative assemblies, each decorative assembly attached to a fan blade, each decorative assembly including:

a collar device adapted for attaching to a fan blade;

a first support cord having a first end and a second end, the first end attached to the collar device;

a first ornamental object attached to the second end of the support cord, wherein the support cord is adapted to suspend the ornamental object when the collar device is attached to the fan blade.

13. A mobile comprising:

a ceiling fan including a first fan blade and a second fan blade, each fan blade rotatably attached to a fan motor;

a first fan ornament assembly including:

a first collar device attached to the first fan blade;

a first support cord having an upper end and a lower end, the upper end of the first support cord attached to the first collar device;

a first ornamental object attached to the second end of the first support cord; and a second fan ornament assembly including:

a second collar device attached to the second fan blade;

a second support cord having an upper end and a lower end, the upper end of the second support cord attached to the first collar device;

a second ornamental object attached to the second end of the second support cord.

14. The mobile kit of claim 13, wherein at least one fan ornament assembly further includes:

a third support cord having a first end and a second end, the first end of the third support cord attached to the first ornamental object;

a third ornamental object attached to the second end of the third support cord.

15. The mobile kit of claim 13, wherein at least one fan ornament assembly further includes:

a third support cord having a first end and a second end, the first end of the third support cord attached to the first collar device;

a third ornamental object attached to the second end of the third support cord.

16. The mobile kit of claim 13, wherein the first collar device is adapted to fit around the first fan blade.

17. The mobile kit of claim 13, wherein the first collar device is comprised of an elastic material.

18. The mobile kit of claim 13, wherein the first collar device is comprised of a fashion garter belt.

19. The mobile kit of claim 13, wherein the first collar device is comprised of a Velcro strap.

20. The mobile kit of claim 13, wherein the first support cord is comprised of one of wire, cable, string, elastic, rope, twine, thread, line, chain, and thread.

21. The mobile kit of claim 13, wherein the first support cord is covered with a decorative fabric.

22. The mobile kit of claim 13, wherein the first support cord is strung with a plurality of decorative beads.

23. The mobile kit of claim 13, wherein the first ornamental object is comprised of one of wood, plastic, metal, paper, cardboard, and foam.

24. A mobile kit for use with a ceiling fan, the kit comprising:

a plurality of fan ornament assemblies, each fan ornament assembly including:

attachment means for attaching to a fan blade;

a first support cord having a first end and a second end, the first end of the first support cord attached to the attachment means;

a first ornamental object attached to the second end of the first support cord, wherein the first support cord is adapted to suspend the first ornamental object when the attachment means is attached to the fan blade.

* * * * *